US006270074B1

(12) United States Patent
Rasmussen et al.

(10) Patent No.: US 6,270,074 B1
(45) Date of Patent: Aug. 7, 2001

(54) PRINT MEDIA VACUUM HOLDDOWN

(75) Inventors: Steve O. Rasmussen; John D. Rhodes, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/292,767

(22) Filed: Apr. 14, 1999

(51) Int. Cl.[7] ..... B65H 29/68
(52) U.S. Cl. ..... 271/276; 271/183; 355/76
(58) Field of Search ..... 271/183, 276; 355/76, 91

(56) References Cited

U.S. PATENT DOCUMENTS

| | | | | |
|---|---|---|---|---|
| 2,717,756 | * | 9/1955 | Keeshan et al. | 355/76 |
| 2,753,181 | * | 7/1956 | Anander | 271/196 |
| 3,617,127 | | 11/1971 | McDuff | 355/73 |
| 3,975,057 | * | 8/1976 | Hurd | 271/183 |
| 4,145,040 | | 3/1979 | Huber | 271/276 |
| 4,202,542 | | 5/1980 | Lammers et al. | 271/276 |
| 4,237,466 | | 12/1980 | Scranton | 346/75 |
| 4,294,540 | | 10/1981 | Thettu | 355/76 |
| 4,378,155 | * | 3/1983 | Nygaard | 355/76 |
| 4,504,843 | | 3/1985 | Prohl et al. | 346/138 |
| 4,792,249 | | 12/1988 | Lahr | 400/578 |
| 4,878,071 | | 10/1989 | Bibl et al. | 346/153.1 |
| 4,921,240 | | 5/1990 | Watson | 271/245 |
| 4,926,199 | | 5/1990 | Bibl et al. | 346/157 |
| 4,952,950 | | 8/1990 | Bibl et al. | 346/157 |
| 4,982,207 | | 1/1991 | Tunmore et al. | 346/138 |
| 5,037,079 | | 8/1991 | Siegel et al. | 271/3 |
| 5,124,728 | | 6/1992 | Denda | 346/134 |
| 5,183,252 | | 2/1993 | Wolber et al. | 271/276 |
| 5,197,812 | | 3/1993 | Worley et al. | 400/635 |
| 5,294,965 | | 3/1994 | May | 355/312 |
| 5,383,001 | | 1/1995 | Bosy | 355/73 |
| 5,510,822 | | 4/1996 | Vincent et al. | 347/102 |
| 5,563,683 | * | 10/1996 | Kamiye | 355/76 |
| 5,717,446 | | 2/1998 | Teumer et al. | 347/35 |
| 5,771,054 | | 6/1998 | Dudek et al. | 347/102 |

* cited by examiner

*Primary Examiner*—H. Grant Skaggs

(57) ABSTRACT

A vacuum holddown for sheet materials has a surface having a field of vacuum ports in which each individual port is gated. When a vacuum is applied to the underside of the holddown, the gates close. When a sheet of material is introduced onto a region of the field, the gates only within vacuum manifold passageway covered by the material are configured to spring open, applying a suction force to the sheet via the now opened ports. The holddown thus automatically adjusts to material size. An implementation for use in an ink-jet printer with cut-sheet print media is demonstrated.

8 Claims, 10 Drawing Sheets

PRINT MEDIA VACUUM HOLDDOWN

RELATED APPLICATIONS

This application is related to co-filed U.S. Pat. application Ser. No. 09/292,125, by John D. Rhodes et al. for Vacuum Control for Vacuum Holddown, and U.S. patent application Ser. No. 09/292,838, by Geoff Wotton et al. for a Vacuum Surface for Wet Dye Hard Copy Apparatus.

BACKGROUND OF THE INVENTION

1. Field of the Invention

The present invention relates generally to a vacuum holddown apparatus and method of operation and, more specifically to a cut-sheet print media vacuum holddown particularly useful for a hard copy apparatus, such as an ink-jet printer.

2. Description of Related Art

It is known to use a vacuum induced force to adhere a sheet of flexible material to a surface, for example, for holding a sheet of print media temporarily to a platen. [Hereinafter, "vacuum induced force" is also referred to as "vacuum induced flow", "vacuum flow", or more simply as just "vacuum" or "suction".] Such vacuum holddown systems are a relatively common, economical technology to implement commercially and can improve throughput specifications. For example, it is known to provide a rotating drum with holes through the surface wherein a vacuum through the drum cylinder provides a suction force at the holes in the drum surface. [The term "drum" as used hereinafter is intended to be synonymous with any curvilinear implementation incorporating the present invention; while the term "platen" can be defined as a flat holding surface, in hard copy technology it is also used for curvilinear surfaces, such as a common typewriter rubber roller; thus, for the purposes of the present application, "platen" is used generically for any shape paper holddown surface used in a hard copy apparatus.]

Generally in a hard copy apparatus implementation, the platen is used either to transport cut-sheet print media to a printing station of a hard copy apparatus, such as a copier or a computer printer, or to hold the sheet media at the printing station while images are formed (known as the "print zone"), or both. [In order to simplify discussion, the term "paper" is used hereinafter to refer to all types of print media. No limitation on the scope of the invention is intended nor should any be implied.]

One universal problem, particularly pertinent in the adaptation of a vacuum holddown to use in a hard copy apparatus, is the management of different sized paper. Open holes around the edges of a sheet smaller than the dimensions of the vacuum field across the platen surface results in vacuum losses for holding. In other words, too many exposed vacuum ports result in a loss of holding suction and the paper is not firmly adhered to the surface. Generally, known apparatus rely on an end-user manually switching operational functions to adjust the vacuum field to match the size of the paper in current use. The apparatus known in the art also often require a fixed position leading edge registration feature in order to implement various transport vacuum size switching.

There is a need for a vacuum holddown for sheet material transport that can automatically adjust to hold a relatively universal variety of sizes of materials. In a hard copy apparatus implementation, the paper transport system preferably should operate while being moved at a relatively high speed (e.g., for a drum rotating at a surface speed approximately 30-inches/second).

SUMMARY OF THE INVENTION

In its basic aspects, the present invention provides vacuum controlled holding apparatus for securing variably sized sheets of flexible material thereon, associated with a vacuum mechanism for generating a vacuum force. The present invention includes: plate mechanisms for sequentially receiving flexible material sheets on a first surface thereof, the plate mechanisms having a plurality of vacuum ports to a second surface thereof, the second surface being subject to the vacuum force; gating mechanisms associated with each of the vacuum ports such that under a first condition, wherein a vacuum port is not covered by a flexible material sheet, the gating mechanisms is closed under influence of the vacuum force and under a second condition, wherein a vacuum port is covered by the flexible material sheet, the gating mechanisms is automatically opened such that the vacuum force is exerted against the flexible material sheet thereby holding the flexible material sheet to the first surface.

In another basic aspect, the present invention provides a method for temporarily securing variably sized, individual sheets of print media to a platen surface using a vacuum mechanisms for generating vacuum force. The method includes the steps of: providing a platen surface with a plurality of discrete vacuum ports therethrough, each of the ports having a gating mechanism for opening and closing the vacuum ports and for segregating the ports into an exterior region and an interior region, wherein the gating mechanism is biased to an open position against atmospheric pressure of the exterior region, and wherein the platen surface has length and width dimensions for sequentially accommodating different sized print media; subjecting each of the vacuum ports to the vacuum force via the interior region, the vacuum force having a predetermined value sufficient for closing the ports with the gating mechanism such that a substantially atmospheric pressure condition exists within the exterior region and a subatmospheric pressure condition exists within the interior region of each of the vacuum ports; and transporting a sheet of print medium onto the platen surface wherein by interaction of the sheet of print medium with the vacuum ports where the print medium is in contact with the platen surface, vacuum ports covered by the sheet of print media have the gating mechanism automatically open due to change in pressure differential between the exterior region and the interior region of the vacuum ports thereby securing the sheet to the platen surface.

In yet another basic aspect, the present invention provides a cut-sheet print medium holddown device for a hard copy apparatus having a mechanism for exerting a vacuum force. The device includes: a platen having a platen top surface having an area sufficient for sequentially accommodating different size sheets thereon, a platen bottom surface, and a field of vacuum ports distributed across the platen coupling the platen top surface and the platen bottom surface; and mechanisms for gating each of the vacuum ports individually wherein sheet coverage of individual vacuum ports causes a pressure differential change across the mechanisms for gating of only sheet-covered vacuum ports, automatically moving the mechanisms for gating associated with sheet-covered vacuum ports from a closed position to an open position such that vacuum force is exerted only through sheet-covered vacuum ports.

In another basic aspect, the present invention provides an ink-jet hard copy apparatus, having a known manner device for producing a vacuum force, where the apparatus includes: printing mechanisms for jetting ink droplets; mounting mechanisms for receiving the printing mechanisms and for selectively positioning the printing mechanisms; and print media holding mechanisms for receiving and capturing a sheet of the media and for transporting a captured sheet to positions within the apparatus where the printing mechanisms is selectively positioned, the print media holding mechanisms including a rotating drum coupled to the device for producing a vacuum force wherein the rotating drum includes a plurality of vacuum ports on an outer surface thereof, mechanisms for manifolding vacuum from a holddown inner surface thereof coupled to the device for producing a vacuum force to the vacuum ports such that the vacuum ports have a first position closing individual the vacuum ports having no region of the sheet present thereon and a second position opening individual vacuum ports having a region of the sheet present thereon.

It is an advantage of the present invention that it provides a vacuum holddown that does not require any change in vacuum for differently dimensioned materials to be held.

It is an advantage of the present invention that it provides an automatic, size compensating, vacuum force distribution method and apparatus.

It is an advantage of the present invention that it provides a vacuum holding surface having reliable vacuum switching.

It is an advantage of the present invention that it provides a vacuum holding surface suitable for use in a hard copy apparatus where the marking subsystem and paper are required to be in close proximity.

It is another advantage of the present invention that it provides a vacuum transport that does not require multi-speed capability, viz. allowing full speed loading and unloading.

It is a further advantage of the present invention that it limits vacuum waste, reducing vacuum power requirements.

It is a further advantage of the present invention that it permits a higher vacuum power, allowing stiffer flexible materials to be transported.

It is still another advantage of the present invention that it eliminates the need for mechanical clamps or fasteners for holding print media.

It is a further advantage of the present invention that it eliminates the need for separate vacuum ON/OFF sensors and switches.

It is yet another advantage of the present invention that it can be adapted to allow multiple sheets of media to be positioned on a platen.

Other objects, features and advantages of the present invention will become apparent upon consideration of the following explanation and the accompanying drawings, in which like reference designations represent like features throughout the drawings.

BRIEF DESCRIPTION OF THE DRAWINGS

FIG. 1A is a top angle view and FIG. 1B is a bottom angle view of the same embodiment.

FIGS. 2A, 2B and 2C are views of a second embodiment of the present invention in which:

FIG. 2A is a partially exploded, perspective view,

FIG. 2B is a close-up detail of a portion of the embodiment as shown in FIG. 2A from the same perspective, and FIG. 2C is a reverse angle view of detail of parts as shown in FIG. 2B.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable. The invention is explained with respect to use in a hard copy apparatus. However, it will be recognized by those skilled in the art that the invention is adaptable for use as a holddown with almost any flexible material, e.g. for transporting sheets of aluminum foil.

Figure 1A:
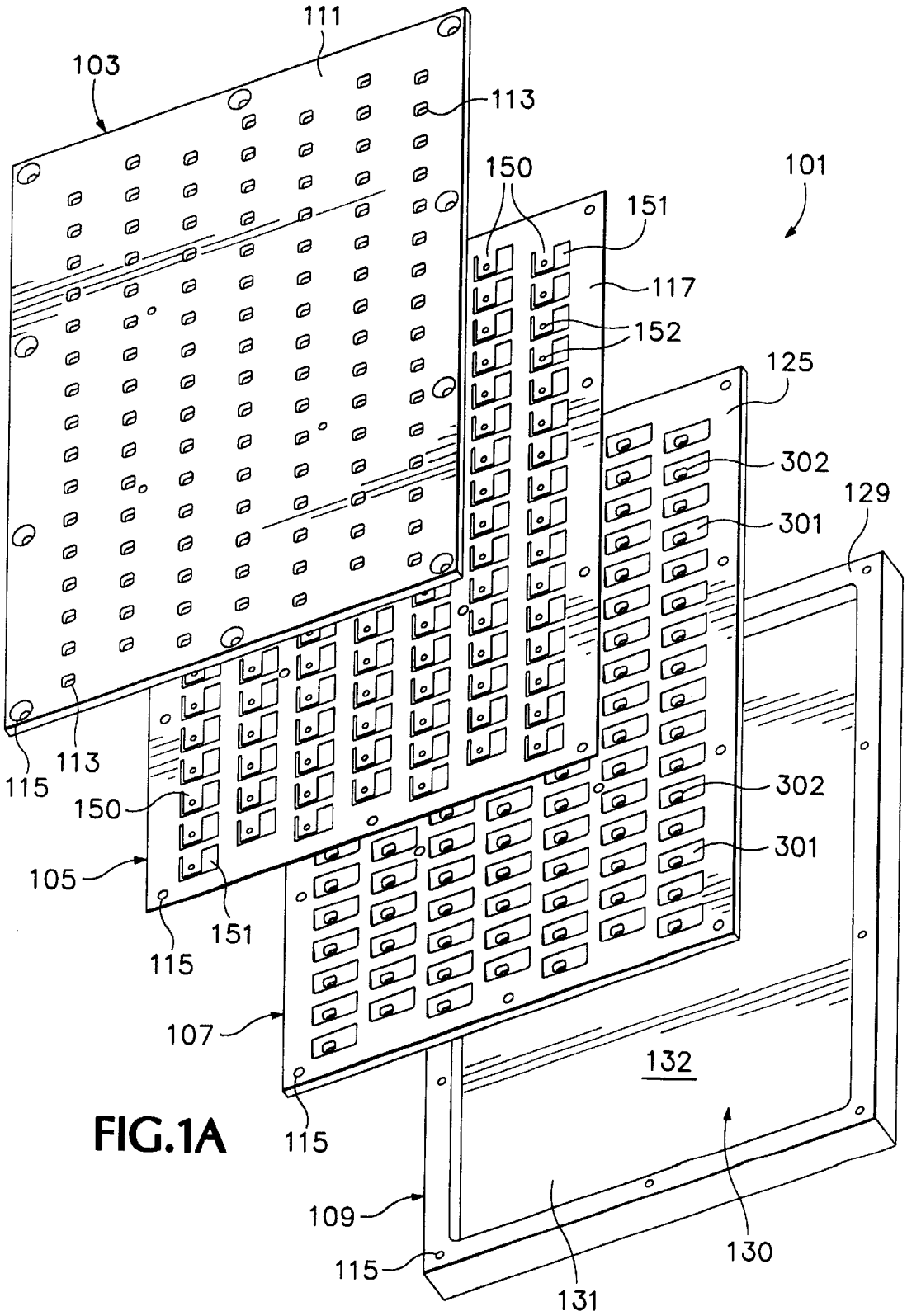
FIGS. 1A and 1B are exploded, perspective views of a first embodiment of the present invention, where
Figure 1B:
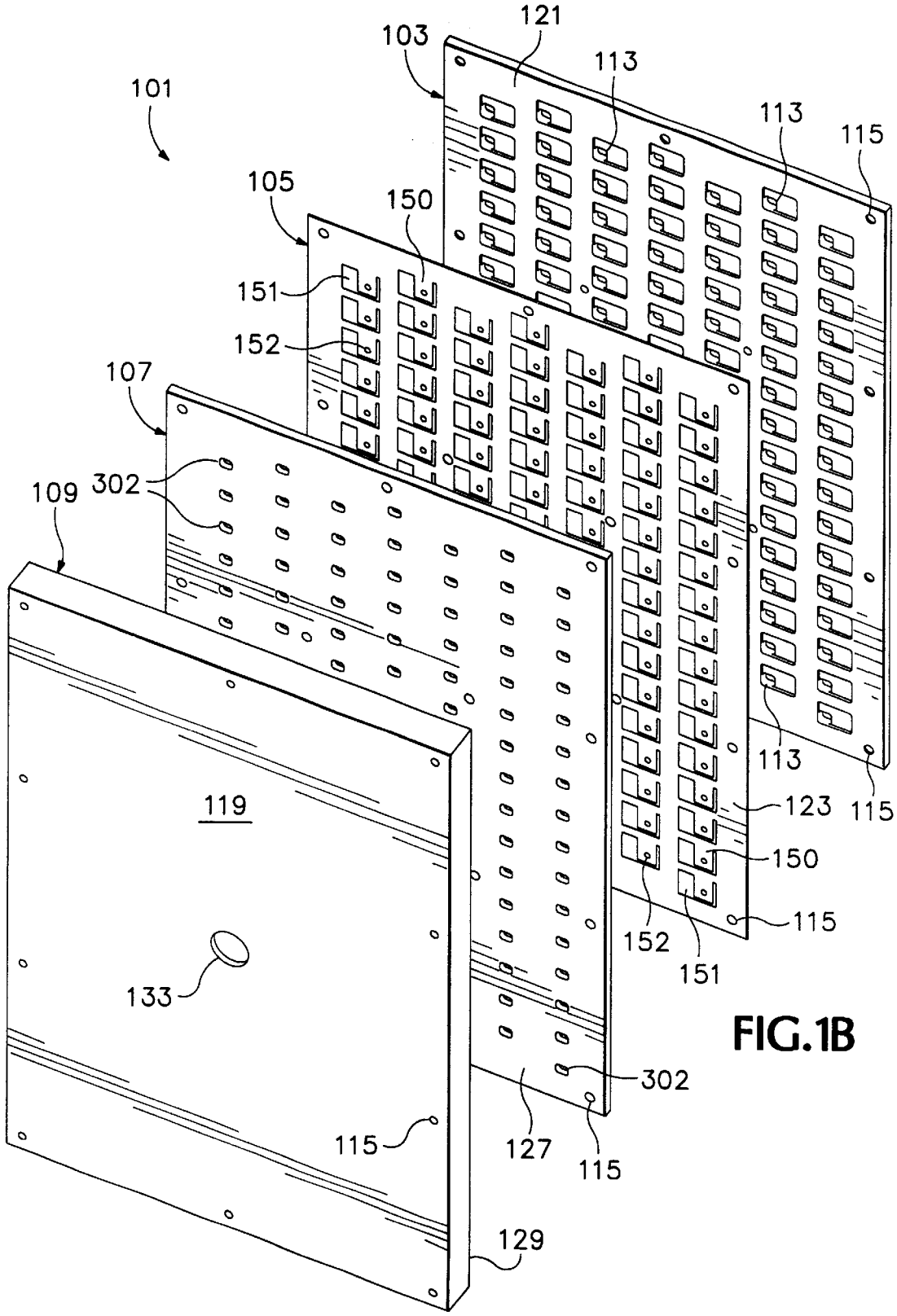
Figure 2A:
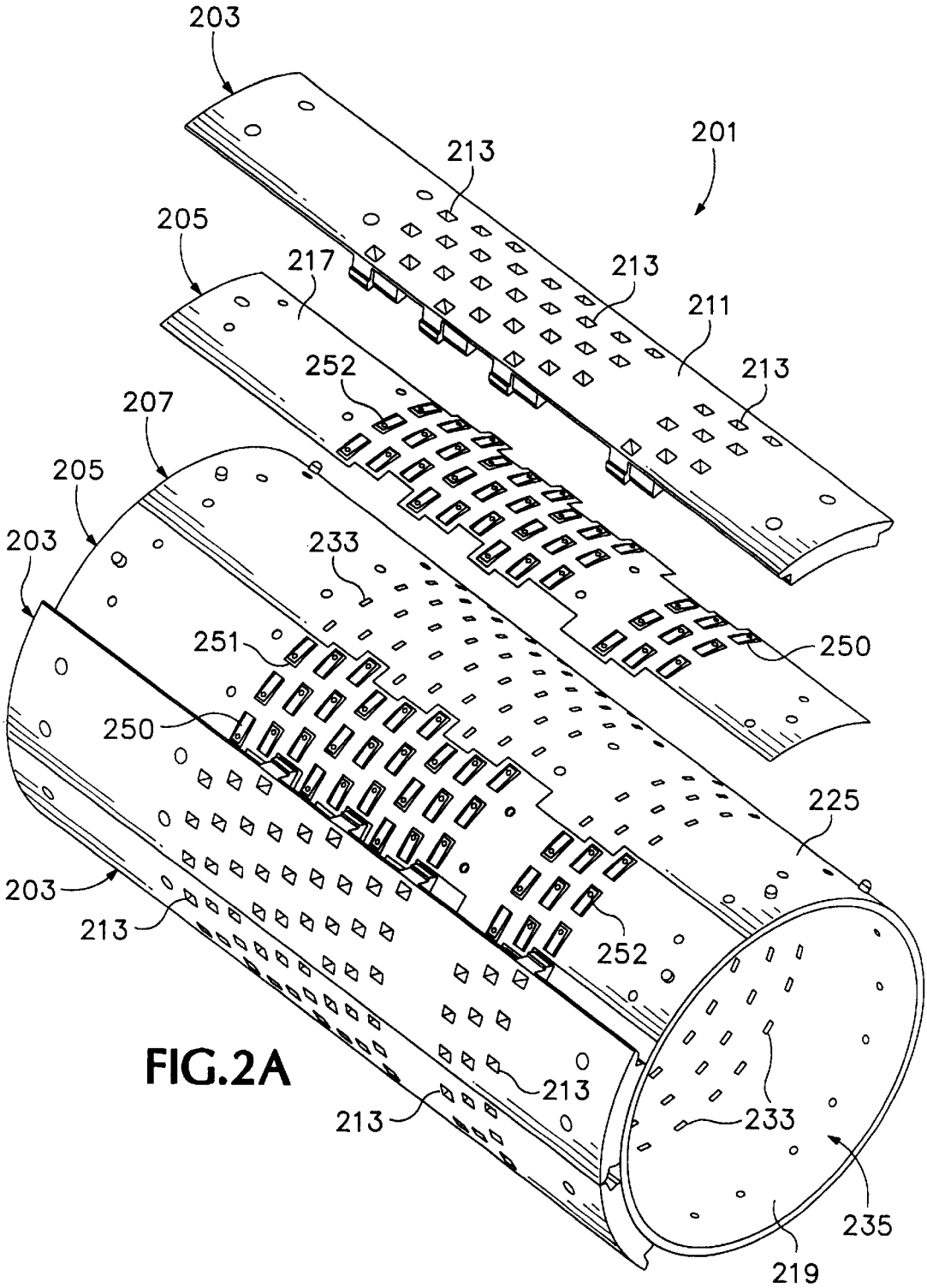
Figure 2B:
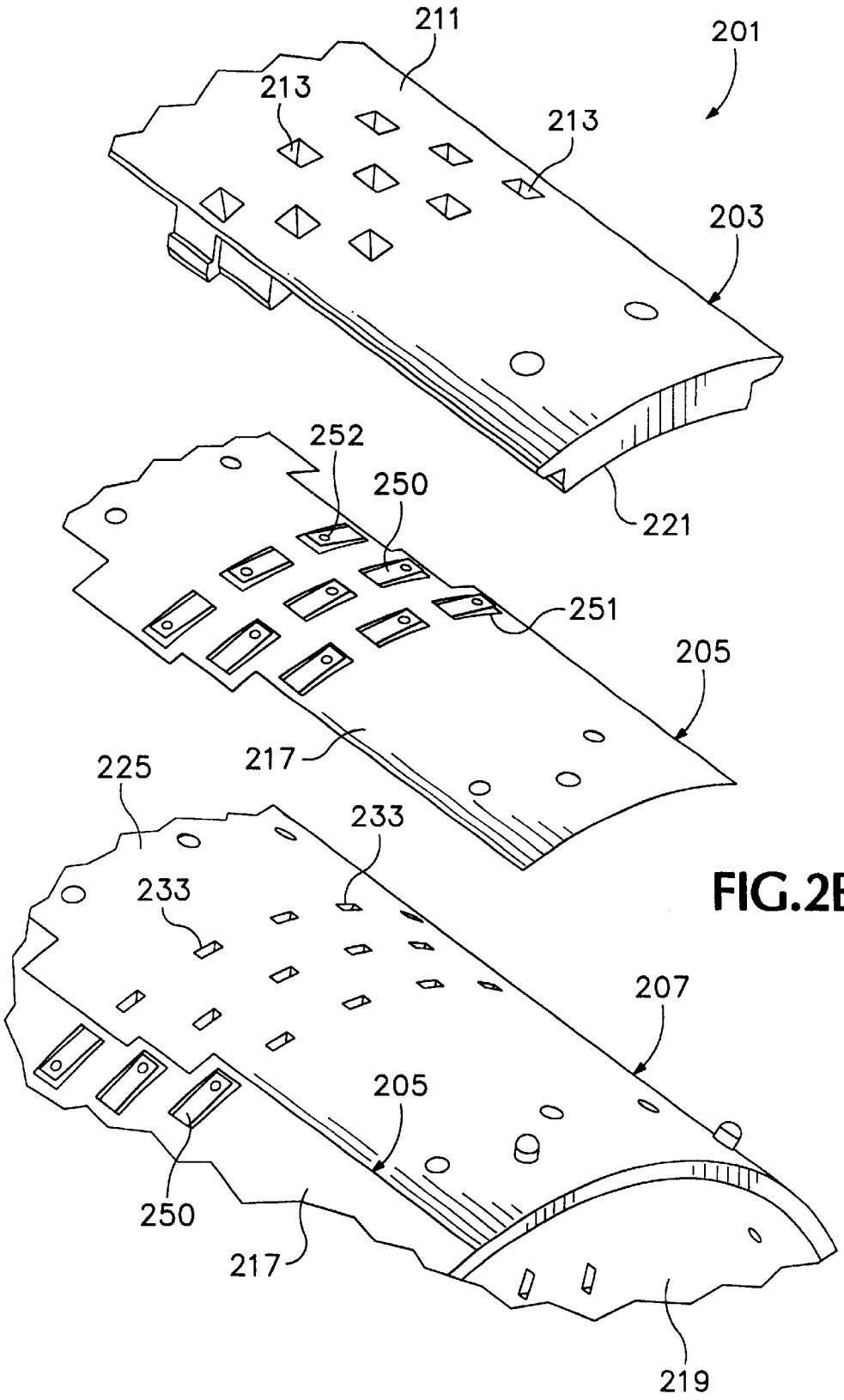
Figure 2C:
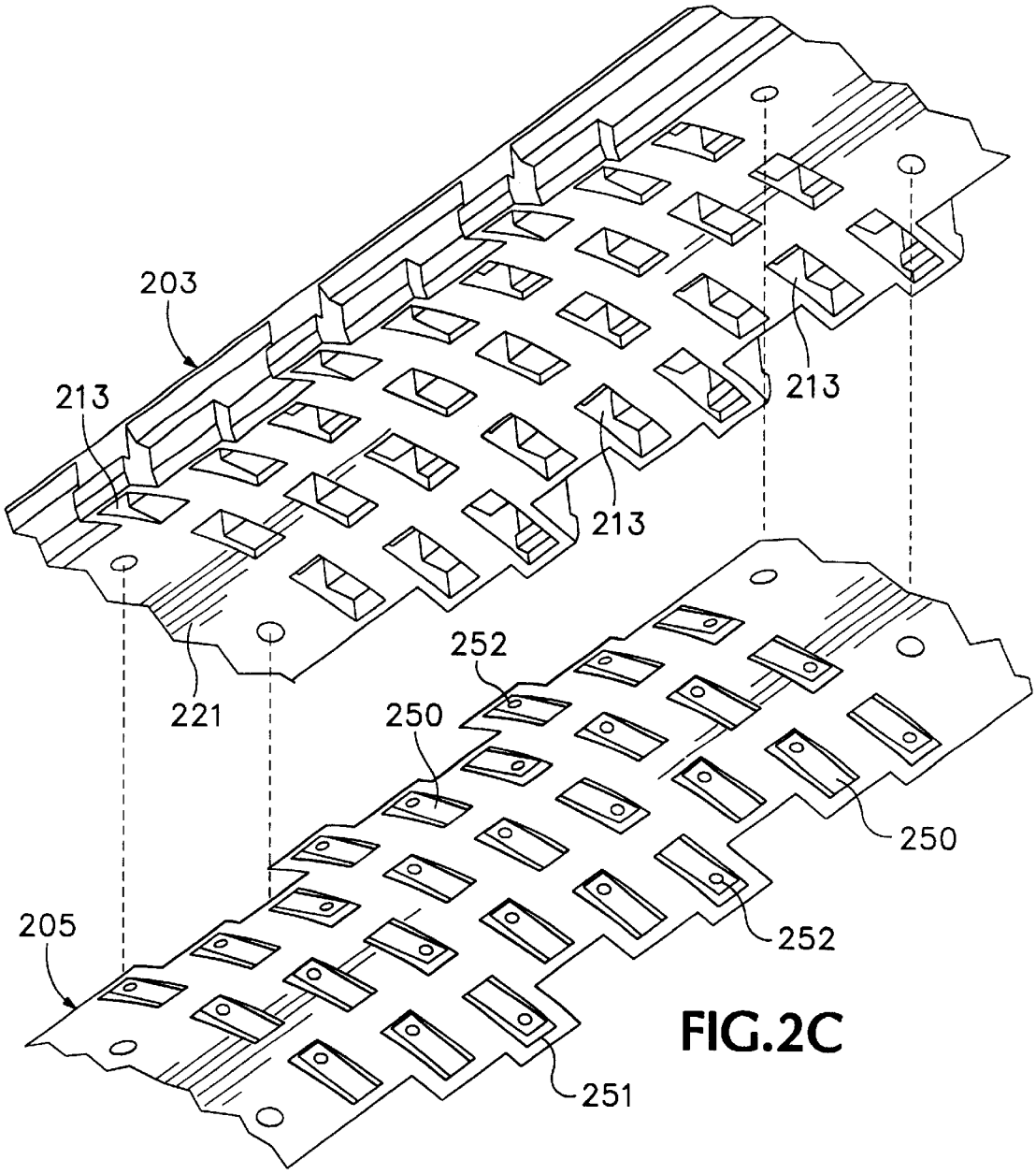

FIGS. 1A and 1B depict a holddown 101 in accordance with the present invention. In this embodiment, the holddown 101 is constructed of four layers 103–109. While the apparatus is shown as a planar construct, it is to be recognized that the apparatus can be formed for any particular implementation into other shapes, for example, a rotating drum holddown 201 implementation as shown in FIGS. 2A–2C. The top plate, or "platen," 103/203 (in FIG. 2, correlating parts are designated with a "2" as the first digit, e.g., 103≈203, so that reference and description can be made to both implementations) is used to receive and hold a sheet of paper thereon. Thus, the top plate 103/203 has a paper-holding surface 111/211 having a plurality of through-holes, or "vacuum ports," 113/213. The vacuum ports 113/213 form the outermost bores and orifices of vacuum passageways through the holddown 101/201. The vacuum ports 113/213 can have shapes, dimensions, and can be arranged in a distribution pattern across the paper-holding surface 111/211 appropriate to any specific design implementation. The vacuum force is conventionally generated, such as with an appropriately configured exhaust fan (not shown), applied to the innermost surface, or "vacuum-side surface", 119/219 (FIGS. 1B and 2A, respectively) of the holddown 101/201. As explained in detail hereinafter, the vacuum force is manifolded through the holddown 101/201 such that any size paper will adhere to the paper-holding surface 111/211 with the vacuum automatically optimized to that size. Subjacent the top plate 103/203 is a valve gate plate 105/205. As shown in FIGS. 1A and 1B, subjacent the valve gate plate 105 is a valve cavity plate 107. Subjacent the valve cavity plate 107 is a base plate 109. As shown in FIGS. 2A and 2B, in the drum holddown 201 embodiment, only a vacuum manifold 207 having a vacuum-side surface 219 is provided subjacent the valve gate plate 205.

The multi-layered holddown 101/201 is assembled in any design expedient known manner, such as with fasteners (not shown) through provided fastener holes 115/215. Commercial adhesives may also be employed. The layers can be formed in any commercially feasible manner; for example, the drum embodiment may be molded of a commercial plastic. As an example, a rotating drum molded of acrylic or polycarbonate plastic having a 21-inch circumference and a 12-inch axial length not only accommodates standard legal paper (8.5×14-inches) but also has sufficient surface area to permit loading of a subsequent sheet while a printed sheet is being unloaded.

The valve gate plate 105/205 has a outer surface 117/217 (FIGS. 1A, 2A and 2B) which, when the holddown 101/201 is fully assembled, will be adjacent the top plate 103/203 vacuum-side surface 121/221 (FIGS. 1B and 2C). In the flat holddown 101 embodiment of FIGS. 1A and 1B, the valve gate plate 105 vacuum-side surface 123 (FIG. 1B) will, when assembled, be adjacent the valve cavity plate 107 outer surface 125 ( FIG. 1A). The valve gate plate 105/205 has a plurality of flexible gates 150/250 which are internally formed in gate-surrounding apertures 151/251 of the plate. In operation, the gates 150/250 are driven by a predetermined pressure differential established in accordance with the methodology of the present invention between atmospheric pressure and the vacuum force to open and close respective vacuum passageways. Each individual gate 150/250 of the valve gate plate 105/205 has a relatively small diameter leakage hole 152/252 bored therethrough (alternative air leakage can be provided as explained hereinafter).

Figure 3:
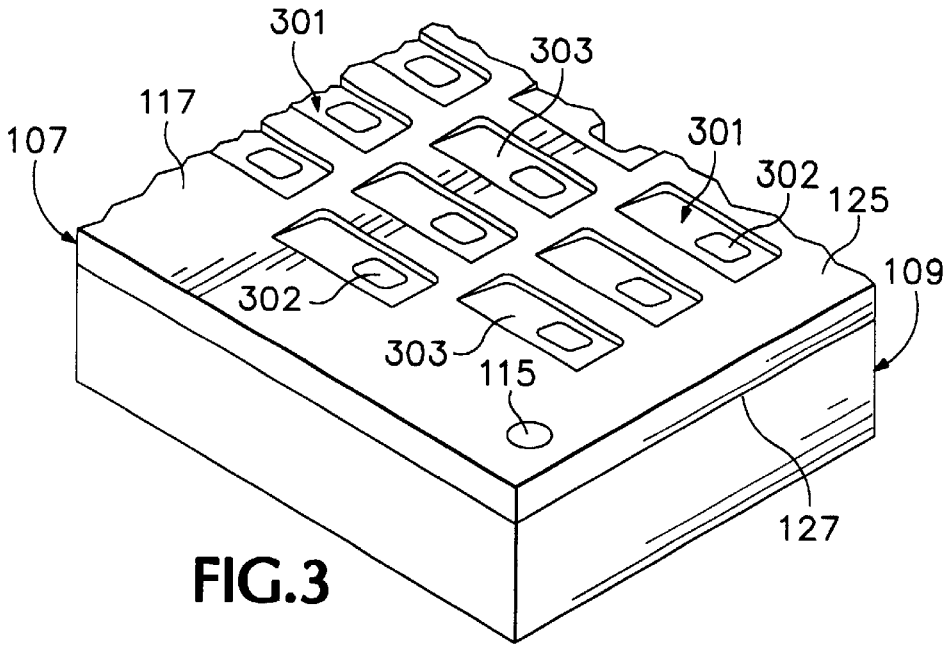
FIG. 3 is a perspective view (top) of detail of the present invention as shown in FIG. 1 with a top plate layer and a valve gate plate layer removed, showing detail of a segment of top surface of a valve cavity plate layer.

Looking also to FIG. 3, the outer surface 125 of the planar valve cavity plate 107 includes a field of recesses 301 and within each recess is a valve cavity plate aperture 302, creating a fluidic coupling between the recess 301 and the valve cavity plate vacuum-side surface 127. The valve cavity plate 107 has a vacuum-side surface 127 (FIG. 1B) which, when the holddown 101 is assembled, will have its perimeter adjacent an outer side perimeter ridge 129 (FIG. 1A) of the base plate 109.

The base plate 109 outer side 130 has a large vacuum distribution cavity 131 having a recessed floor 132. A central floor aperture 133 (FIG. 1B) fluidically couples the cavity 131 to the vacuum-side surface 119 of the base plate 109. In an alternative embodiment, the base plate 109 may be a simple flat plate with a field of holes that when assembled adjacently the valve cavity plate 107 are each individually aligned with the valve cavity plate apertures 302.

In the drum holddown 201 of FIGS. 2A–2C, the valve gate plate 205 has a vacuum-side surface 223 (FIG. 2C) adjacent the vacuum manifold 207 outer surface 225 (FIGS. 2A and 2B). The vacuum manifold 207 has a field of vacuum apertures 233 extending from its outer surface 225 to its vacuum-side surface 219.

Figure 4:
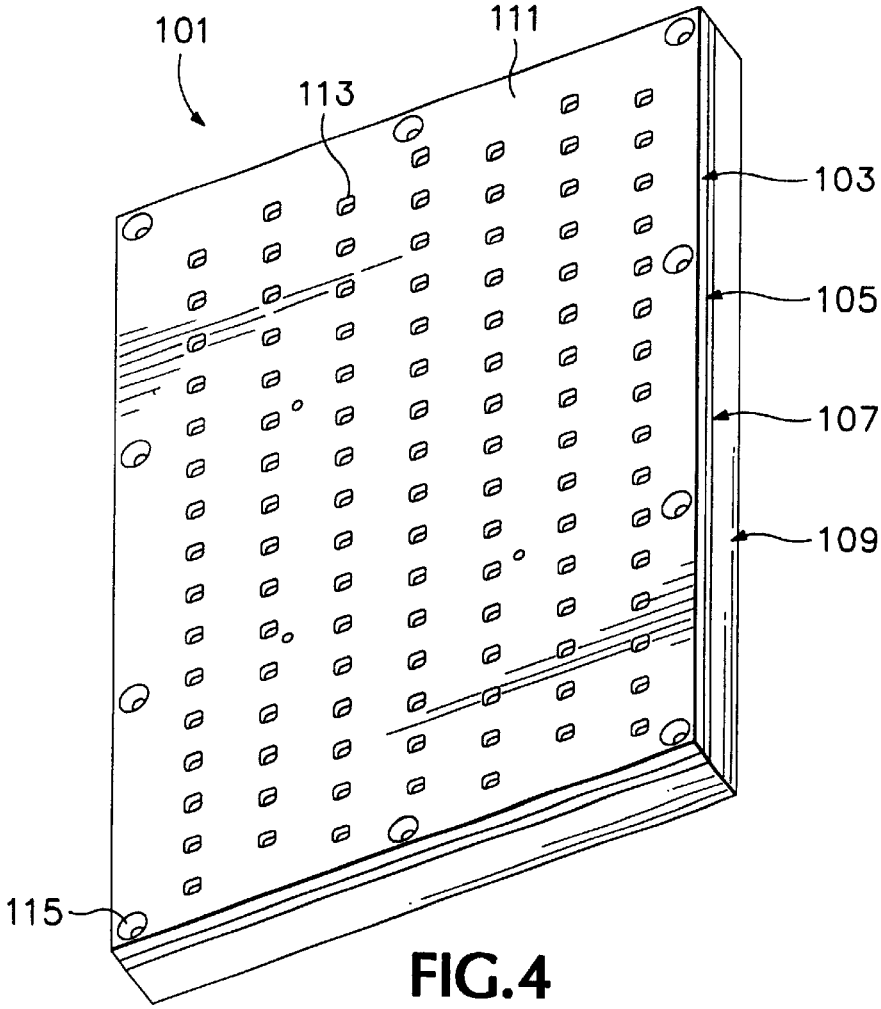
FIG. 4 is a perspective view (top) depicting an assembled holddown apparatus in accordance with the present invention as shown in FIGS. 1A and 1B, including a top plate layer, a valve gate plate layer, the valve cavity plate layer as also shown in FIG. 3, and a base plate layer.

FIG. 4 shows the assembled planar holddown 101 wherein each construct layer overlies the next subjacent layer to form a unit. It should be recognized that the number of layers is not a limitation on the scope of the invention as the construct can be manipulated in accordance with standard engineering practices.

As should now be recognized a vacuum manifolding system is created when the layers of the holddown 101/201 are assembled. In the planar holddown embodiment 101, each vacuum port 113 of the platen 103 is sequentially aligned with a valve gate plate 105 aperture 151 adjacent an associate gate 150 therein; the valve gate plate 105 aperture 151 is aligned with a valve cavity plate 107 recess 301 such that the gate 150 with its leakage hole 152 is aligned with the recess 301 aperture 302; each aperture 302 opens into the base plate 109 cavity which in turn is subject to a vacuum force via floor hole 133. Thus, this arrangement forms a vacuum passageway extending from the vacuum-side surface 119 of the base plate 119 all the way through to the paper holding surface 111 of the platen 103.

In the drum holddown 201 of FIGS. 2A–2C, it can now be recognized that a vacuum passage way is similarly formed from the internal cavity 235 of the drum's cylindrical construct to the paper holding surface 211. Specifically, starting from the paper holding surface, each platen 203 vacuum port 213 emerges from the platen 203 vacuum- side surface 221 (FIG. 2C) into an expanded cavity 213' that is aligned with a valve gate plate 205 gate surrounding aperture 251 with its associated flexible gate 250 and its leakage hole 252 aligned with the vacuum port 213; each gate surrounding aperture 251 is aligned with a vacuum manifold 207 aperture 233. Note that the expanded cavity 213' is sized and dimensioned in accordance with the size and dimensions of the subjacent flexible gate 250 such that the gate, being cantilevered tangentially to the circular surface of the valve gate plate 207, is received in the expanded cavity without closing the vacuum port 213.

Figure 5:
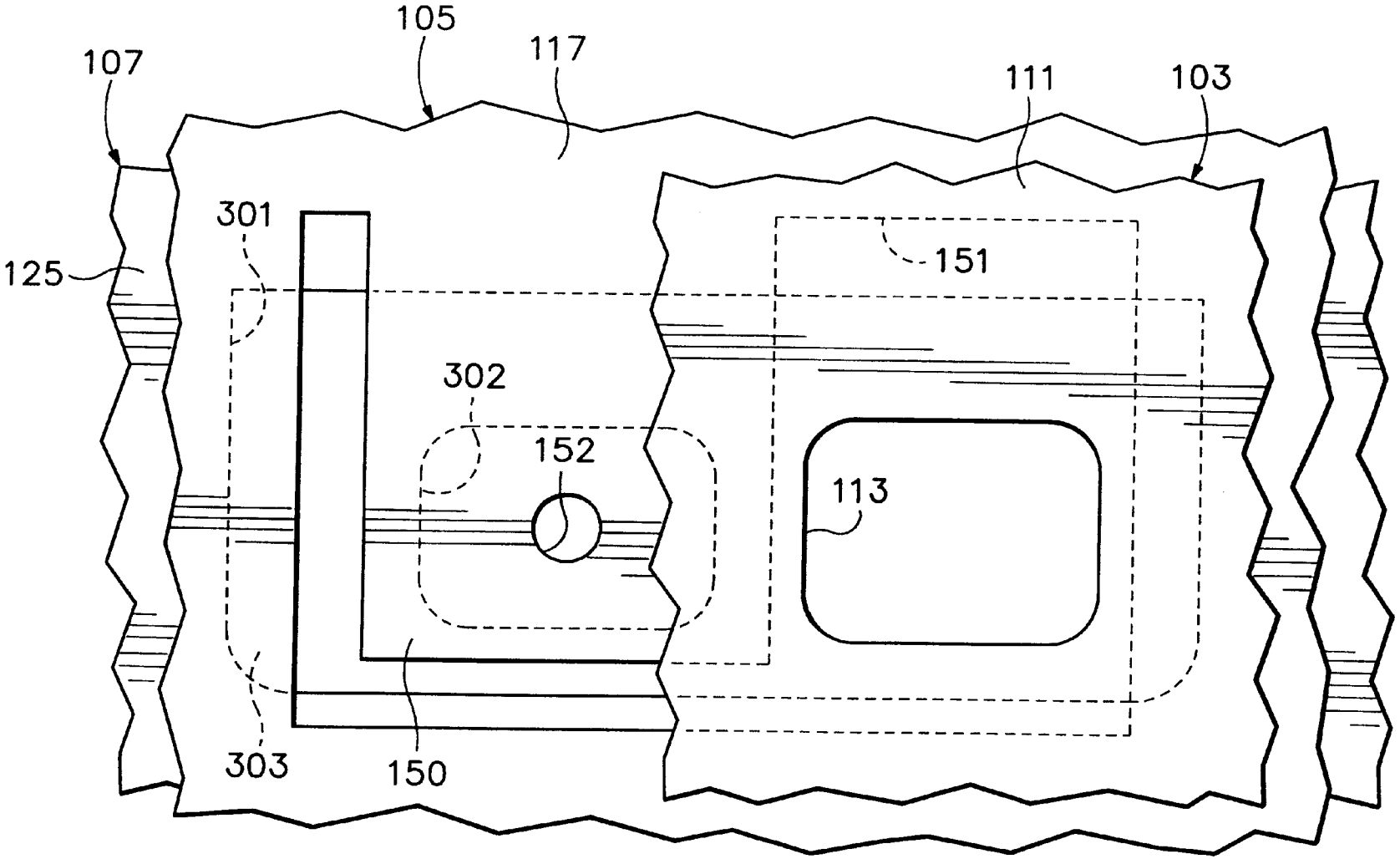
FIG. 5 is a plan view schematic transparency depicting relative vacuum passageway apertures and a valve gate alignment in accordance with the present invention as shown in FIGS. 1A, 1B and 3.

FIG. 5 schematically shows the relative alignment of elements of the invention which form the gated vacuum passageway through the holddown 101. It is preferred to have the platen 103 vacuum port 113 and the valve cavity plate 107 apertures 302 offset. When the gate 150 is open, the flow through the vacuum passageway is directed across the cavity floor 303 so as not to have to go around both sides of the gate 150, alleviating any tendency toward vibrational instability of the gate when the passageway is open. However, flow around the gate when the vacuum passageway is open is a viable alternative in accordance with engineering practices if it is a design expedient for a particular implementation.

Figure 6:
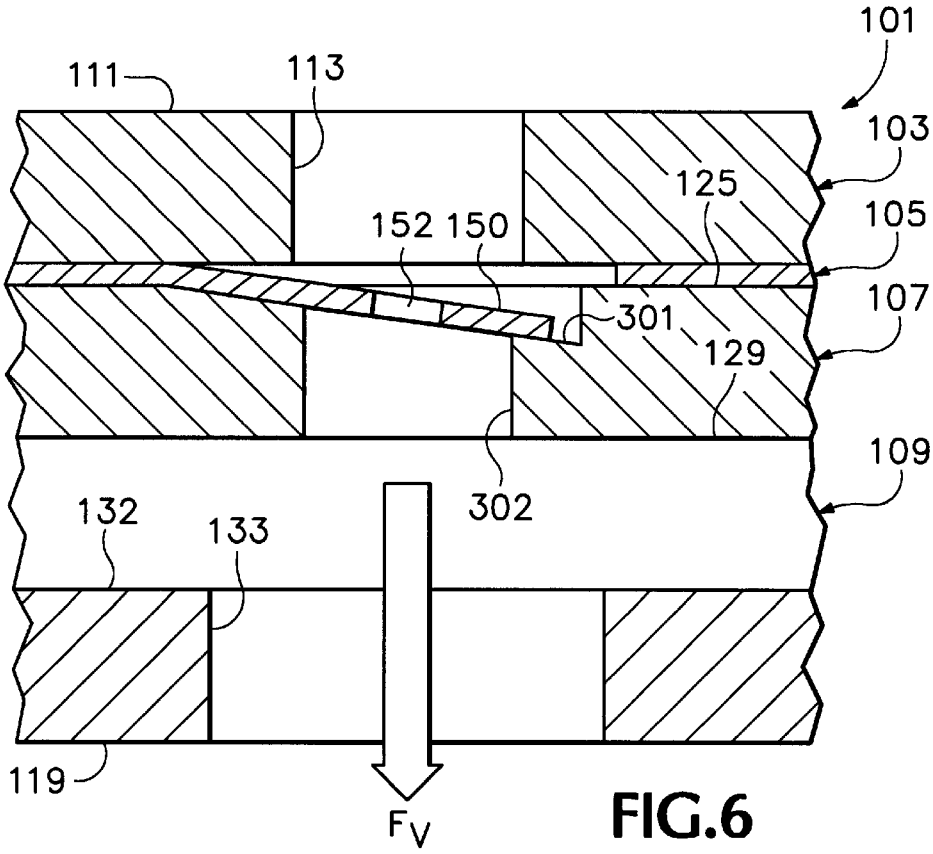
FIG. 6 is a cross-sectional, elevation schematic of a construct in accordance with FIGS. 1A, 1B and 3 showing a vacuum passageway in a closed configuration.
Figure 7:
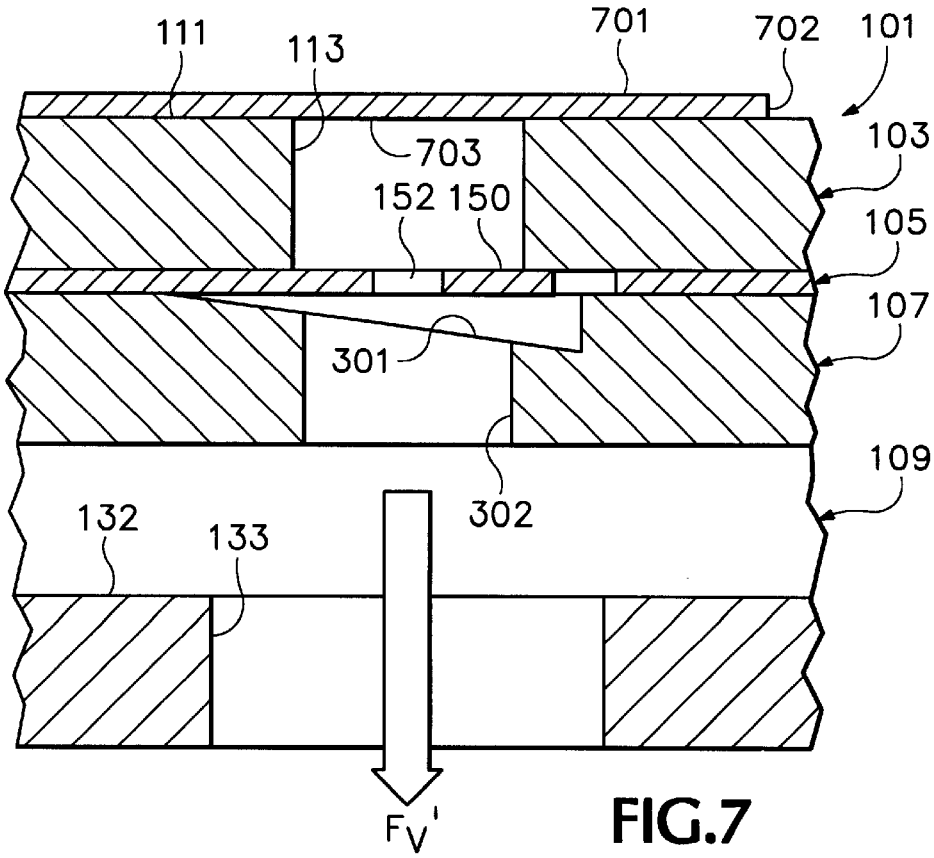
FIG. 7 is a cross-sectional, elevation schematic of the construct as shown in FIG. 6 showing a vacuum passageway in an open configuration.

Turning now to FIGS. 6 and 7, the operation of the planar holddown 101 is demonstrated; the same principles apply to the drum holddown 201. FIG. 6 is a schematic, partial cross-section, elevation view showing platen 103, subjacent valve gate plate 105, valve cavity plate 107, and base plate 109 in their relative alignment which creates the vacuum passageway through the holddown 101.

With no sheet of paper on the paper-holding surface 111 of the platen 103, a vacuum is being pulled sequentially through the base plate 109 bore 133, the base plate cavity 131, the aperture 302 of the valve cavity plate 107, and the relatively small (compared to the vacuum passageway cross-sectional flow area) leakage flow hole 152 through the gate 150 which is cantilevered over the cavity plate 107 outer surface 125 recess 301 with a predetermined force—arrow Fv —designed to be sufficient to deflect a cantilevered gate 150 of the valve gate plate 105 against a floor 303 of the recess. That is, with the vacuum generating mechanism engaged, above the paper-holding surface 111 and in vacuum port 113 there is generally atmospheric pressure; in the valve cavity plate aperture 302 and base plate cavity 132 and bore 133 and below the base plate 109 vacuum-side surface 119 there is generally a subatmospheric pressure. In other words, when so deflected, the cantilevered gate 150 substantially seals off the vacuum passageway except for the slight bleed of air through the bleed, leakage flow hole 152.

As shown in FIG. 7, when a sheet of paper 701 is delivered (in a conventional manner such as with a pinch roller device- not shown) to the platen 103, the leading edge 702 begins to cover a row of vacuum ports 113 of the platen 103. The vacuum force—arrow $F_v$'—dynamic is now altered. Once closed off to the atmosphere by the paper 701, via the leakage hole 152 a vacuum state now builds—nearly instantaneously—such that a vacuum exists both within vacuum port 113 and through the vacuum passageway formed through the valve cavity plate 107 and base plate 109 under the valve gate plate 105. Hence, the cantilevered gate 150 opens under the force of its normal cantilever bias (or alternatively a known manner actual bias spring provided (not shown)) and the vacuum force is applied to the underside 703 of the paper 701. It is estimated that a flow through the leakage hole that is approximately ten-percent of the full vacuum pull force through an open vacuum passageway is appropriate.

Note that the leakage hole 152 can be replaced with any mechanism that allows a leakage around the gate 150 sufficient such that the pressure differential across the gate, i.e., between the exterior region of the platen 103 vacuum port 113 and the interior region of the platen vacuum port, flips the gate between the open and closed state of the passageway.

Figure 8A:
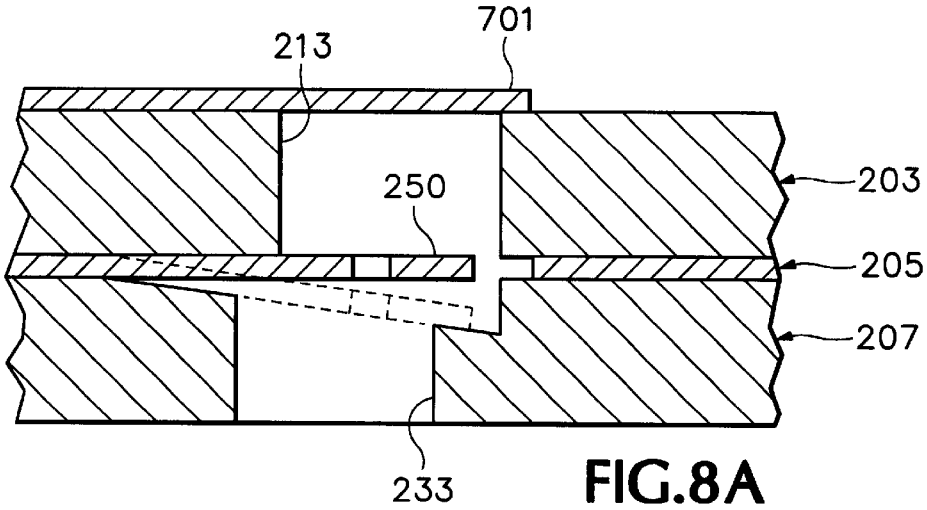
FIGS. 8A and 8B are elevation views, schematically showing a vacuum passageway operation for valve gates for alternative embodiments as depicted in FIGS. 2A–2C, 6 and 7.
Figure 8B:
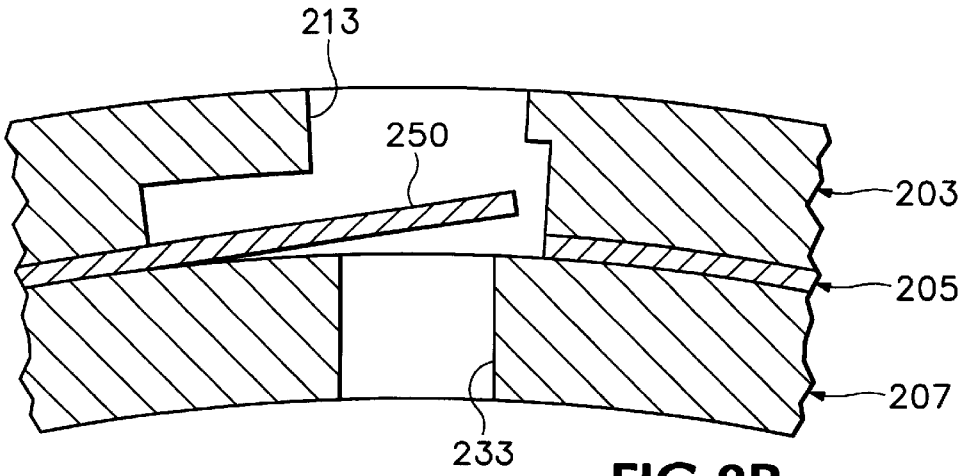

FIGS. 8A and 8B demonstrates the same operational principle in alternative embodiments to FIGS. 6 and 7.

In a more generalized operational mode, assume for example that a conventional hard copy apparatus has length and width dimensions to accommodate at least a sheet of paper that is 8.5×14-inches. When a 5×7-inch dimensioned sheet is on its the platen, a majority of the vacuum holes are left uncovered. Immediately, seeking the least resistance, the vacuum flow will increase at uncovered holes and decrease at the covered holes. Left alone, the vacuum force against uncontrolled, paper-covered holes would decrease to a value insufficient to hold the paper firmly against a platen. However, in accordance with the present invention, the uncovered platen 103 vacuum ports 113 have a vacuum force sufficient to maintain deflection of the cantilevered gates 150, keeping uncovered passages through the hold-down 101 closed while simultaneously losing the atmospheric pressure differential in the covered vacuum passageways through the construct such that the cantilevered gates 150 beneath the paper 701 covered vacuum ports 113 springs back to its open position as shown in FIG. 7, now applying a vacuum force to the underside of the paper to firmly hold it in position on the top surface 111 of the platen 103. Because only the media-covered platen suction ports are opened when and as the media is delivered to the platen, it can be recognized that the hard copy apparatus employing the present invention automatically adjusts itself to hold that size media, keeping all other surface vacuum ports 113 closed.

For a specific implementation, it is necessary only to determine the relative flow rates and strength of materials employed (plastics and metals will exhibit different operating characteristics) using standard engineering calculations. In a wet dye printing apparatus, the vacuum ports should have the smallest practical diameter which will hold the paper to the platen yet not affect the wet print.

Figure 9:
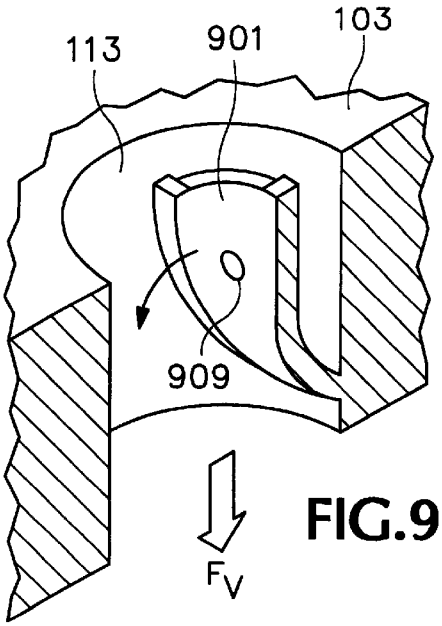
FIG. 9 is a perspective, cross-sectional, detail view of an alternative embodiment for a gated vacuum port in accordance with the present invention.
Figure 10:
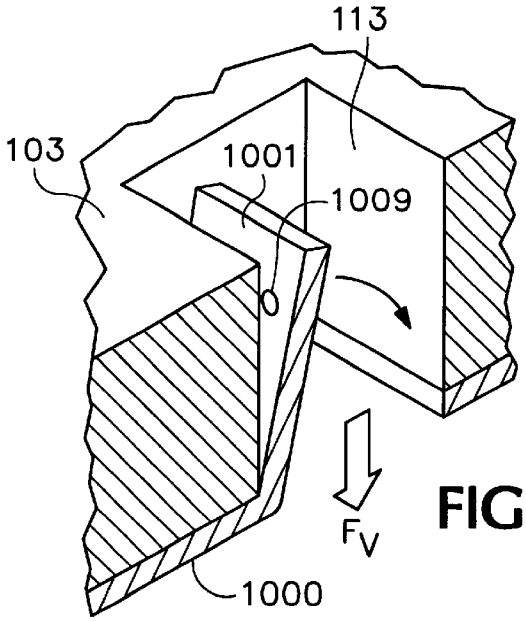
FIG. 10 is a perspective, cross-sectional, detail view for another alternative embodiment for a gated vacuum port in accordance with the present invention.

The present invention commends itself to a variety of implementations, including those which reduce the number layers required. Some alternative embodiments are depicted in FIGS. 9 and 10. In FIG. 9, an integrally molded flap 901 into the platen 103 vacuum port 113 itself acts as the gate under a predetermined vacuum force to close off the vacuum passageway. In FIG. 10, a similar, vacuum port 113 flap 1001 construct is depicted using a two layer construct which simplifies manufacturability. Known manner elastomer fabrication techniques can be used to implement these embodiments.

Figure 11:
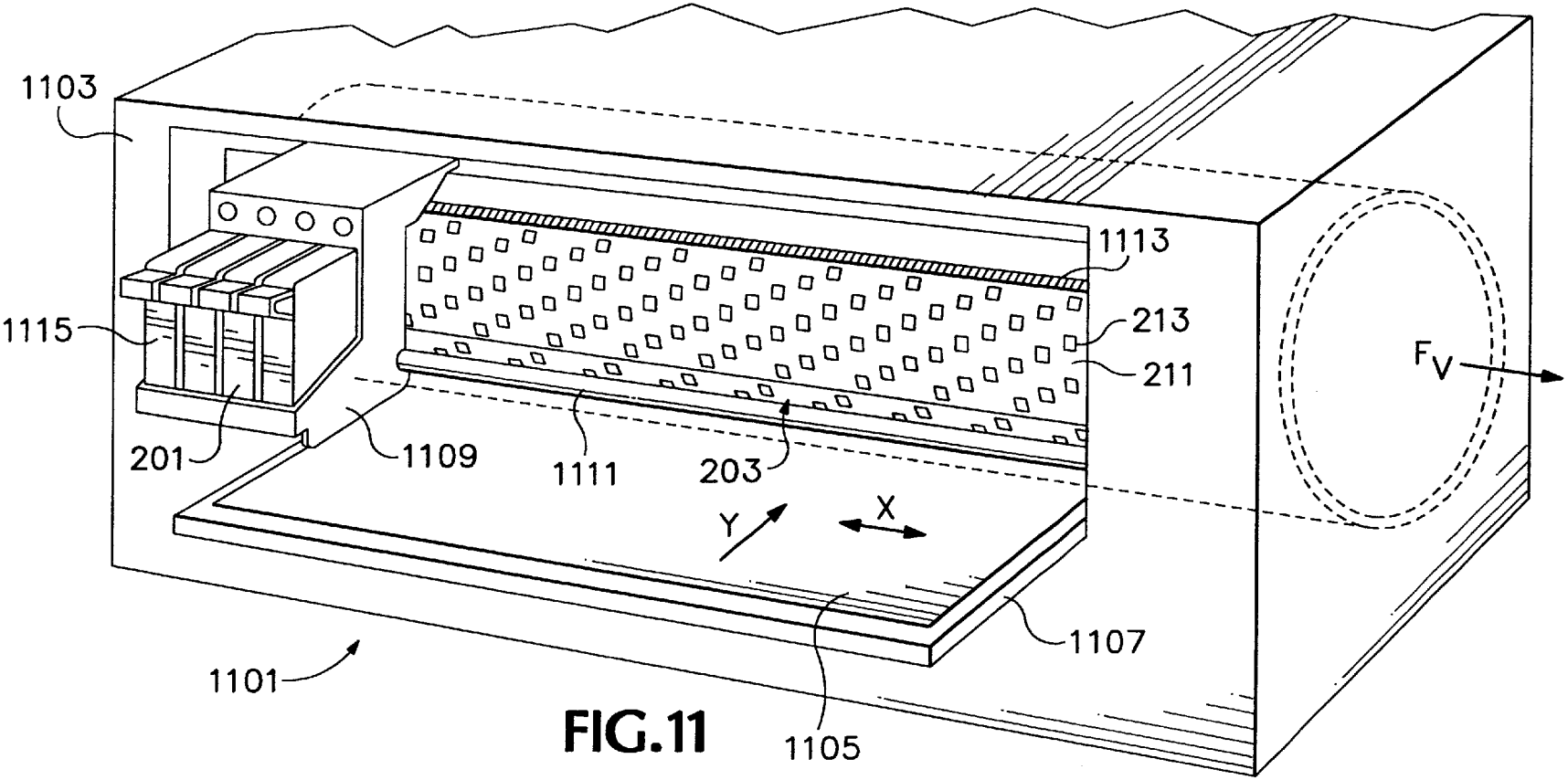
FIG. 11 is a perspective drawing of an ink-jet hard copy apparatus in accordance with the present invention, incorporating a vacuum drum platen as demonstrated by FIGS. 2A–2C.

FIG. 11 depicts an ink-jet printer 1101 which employs the present invention as a paper platen. [The art of ink-jet technology is relatively well developed. Commercial products such as computer printers, graphics plotters, copiers, and facsimile machines employ ink-jet technology for producing hard copy. The basics of this technology are disclosed, for example, in various articles in the Hewlett-Packard *Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [sic] Devices, chapter 13 (Ed. R. C. Durbeck and S. Sherr, Academic Press, San Diego, 1988).] A housing 1103 encloses the electrical and mechanical operating mechanisms of the printer 1101. Operation is administrated by an electronic controller (usually a microprocessor or application specific integrated circuit ("ASIC") controlled printed circuit board, not shown) connected by appropriate cabling to the computer (not shown) It is well known to program and execute imaging, printing, print media handling, control functions, and logic with firmware or software instructions for conventional or general purpose microprocessors or ASIC's. Cut-sheet print media 1105, loaded by the end-user onto an input tray 1107, is fed by a suitable paper-path transport mechanism (not shown) to a drum construct vacuum holddown 201 which captures the sheet on platen 203 surface 211 in accordance with the foregoing described method and apparatus details and moves it to an internal printing station. A carriage 1109, mounted on a slider 1111, scans across the print medium in the X-axis (see labelled arrow). An encoder strip 1113 and appurtenant known manner devices (not shown) are provided for keeping track of the position of the carriage 1109 at any given time. A set of individual ink-jet pens, or print cartridges 1115 are releasably mounted in the carriage 1109 for easy access and replacement (generally, in a full color system, inks for the subtractive primary colors, cyan, yellow, magenta (CYM) and true black (K) are provided). Each pen or cartridge has one or more printhead mechanisms (not seen in this perspective) for "jetting" minute droplets of ink to form swaths of dots on adjacently positioned print media where graphical images or alphanumeric text are created using state of the art dot matrix manipulation techniques.

A variety of mechanisms for removing a sheet of paper on a vacuum holddown—such as blowers, selectable lift fingers, and the like—are known in the art and can be employed in conjunction with the present invention. Further explanation is not necessary to an understanding of the present invention.

Thus, the present invention provides a vacuum holddown 101/201 for sheet materials has a surface 111/211 having a field of vacuum ports 113/213 in which each individual port is gated 105/205, 901, 1001. When a vacuum is applied to the underside of the holddown, the gates close. When a sheet of material 701 is introduced onto a region of the field, the gates only within vacuum manifold passageway covered by the material are configured to spring open, applying a suction force to the sheet via the now opened ports. The holddown thus automatically adjusts to material size.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. A vacuum controlled holding apparatus for securing variably sized sheets of flexible material thereon, associated with a vacuum means for generating a vacuum force, comprising:

plate means for sequentially receiving a flexible material sheet on a first surface thereof, the plate means having a plurality of vacuum ports leading to a second surface thereof, the second surface being subject to the force;

gating means associated with each of the ports such that under a first condition, wherein a port is not covered by the sheet, the gating means is closed under influence of the force, and under a second condition, wherein a port is covered by the sheet, the gating means is automatically opened such that the force is exerted against the thereby holding the sheet to the first surface, the gating means including a plurality of flaps with a flap located at least partially within each port, each flap being biased to a first position opening the port and each flap including a leakage hole therethrough such that when the port is uncovered the force moves the flap to a second position closing the port and when the port is covered by a region of the sheet, the force creates a vacuum condition between the sheet and the flap via the leakage hole such that the flap moves under bias force to the first position, and the gating means including a flexible material layer mounted subjacent the plate means such that each of the flaps extends from the flexible material layer into an associated vacuum port.

2. A paper holddown device for printers having a vacuum force, comprising:

a platen having a paper transport surface having a surface area sufficient for accommodating different sized paper thereon, a vacuum-force-side surface in communication with the vacuum force, and discrete vacuum ports coupling the surface area and vacuum-force-side surface; and a gate within each of the ports, wherein a sheet of paper on said surface covering individual ports causes a pressure differential change across an associated gate of each covered port, automatically moving the associated gate from a first position to a second position such that the vacuum force is exerted only through each covered port, wherein the platen includes a plate subjacent said paper transport surface, the plate having substantially same circumferential dimensions as the surface area, and the plate including a plurality of flaps wherein each one of said flaps is extending into a respective vacuum port adjacent thereto and forming said gate therein, each flap including a leakage means for pulling air from a vacuum port region above the flap with each of the respective ports when the flap is in the port-closed position.

3. The holddown as set forth in claim 2, comprising:

each flap is biased toward a vacuum port open position when no vacuum force is applied and wherein a predetermined vacuum force applied moves the flap to a vacuum port closed position, the leakage means pulling air from a vacuum port inner region located between the flap and the platen surface area located above the flap when the flap is in the vacuum port closed position.

4. The holddown as set forth in claim 2, the plate comprising:

a first member mounted subjacent the platen vacuum-force-side surface, the first member including said flaps as a plurality of cantilevered gate valves located substantially in alignment with each of the vacuum ports in the field, respectively, and wherein each of the cantilevered gate valves is located adjacent respective the vacuum ports, each of the cantilevered gate valves having a valve-open position extending partially across an aligned respective vacuum port when no vacuum force is applied to the vacuum ports, and a second member mounted subjacent the first member, the second member having a second member top surface including a plurality of recessed cavities aligned with respective the cantilevered gate valves, each recessed cavity having an aperture in proximate alignment to respective the vacuum ports and extending from the second member top surface through a second member bottom surface such that when the gate valves are in the valve-open position extending partially across an aligned respective vacuum port, the vacuum ports and the apertures form a passageway through the first member and the second member wherein each passageway is selectively substantially closed by applying the vacuum force to the second member bottom surface at a predetermined flow rate causing the cantilevered gate valves to move into the recessed cavities to a valve-closed position substantially closing the passageway.

5. The device as set forth in claim 4, wherein the second member further comprises:

each aperture in the recessed cavity and each vacuum port proximate thereto are offset in alignment by a distance greater than a cross-dimension of the cantilevered gate valve necessary to close the aperture.

6. The device as set forth in claim 4, wherein the second member further comprises:

means for leaking air from each cantilevered gate valve such that a vacuum condition is established both above and below the cantilevered gate valve when a respective vacuum port is covered by the sheet.

7. The device as set forth in claim 2, further comprising:

the holddown device is a curvilinear construct.

8. A vacuum controlled holding apparatus for securing variably sized sheets of flexible material thereon, associated with a vacuum means for generating a vacuum force, comprising:

plate means for sequentially receiving a flexible material sheet on a first surface thereof, the plate means having a plurality of vacuum ports leading to a second surface thereof, the second surface being subject to the force;

gating means associated with each of the ports such that under a first condition, wherein a port is not covered by the sheet, the gating means is closed under influence of the force, and under a second condition, wherein a port is covered by the sheet, the gating means is automatically opened such that the force is exerted against the thereby holding the sheet to the first surface, the gating means including a plurality of flaps with a flap located at least partially within each port, each flap being biased to a first position opening the port and each flap including a leakage hole therethrough such that when the port is uncovered the force moves the flap to a second position closing the port and when the port is covered by a region of the sheet, the force creates a vacuum condition between the sheet and the flap via the leakage hole such that the flap moves under bias force to the first position, and each the flap being integrally molded into a wall of an associated vacuum port.

* * * * *